US010069245B2

(12) United States Patent
Huhmann et al.

(10) Patent No.: US 10,069,245 B2
(45) Date of Patent: Sep. 4, 2018

(54) MODULAR PLUG CONNECTOR

(71) Applicant: HARTING Electric GmbH & Co. KG, Espelkamp (DE)

(72) Inventors: Andreas Huhmann, Espelkamp (DE); John Witt, Detmold (DE); Andreas Nass, Warmsen (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 15/560,453

(22) PCT Filed: Mar. 16, 2016

(86) PCT No.: PCT/DE2016/100122

§ 371 (c)(1),
(2) Date: Sep. 21, 2017

(87) PCT Pub. No.: WO2016/150429

PCT Pub. Date: Sep. 29, 2016

(65) Prior Publication Data

US 2018/0076570 A1 Mar. 15, 2018

(30) Foreign Application Priority Data

Mar. 23, 2015 (DE) ..... 10 2015 004 808

(51) Int. Cl.
*H01R 4/01* (2006.01)
*H01R 13/62* (2006.01)
(Continued)

(52) U.S. Cl.
CPC ..... *H01R 13/6397* (2013.01); *H01R 13/514* (2013.01); *H01R 13/518* (2013.01);
(Continued)

(58) Field of Classification Search
CPC ..... H01R 4/01; H01R 13/62; H01R 13/639; H01R 13/6275; H01R 13/193
(Continued)

(56) References Cited

U.S. PATENT DOCUMENTS 3,801,954 A * 4/1974 Dorrell ..... H01R 13/6277 285/187
4,398,230 A * 8/1983 Joannais ..... H01R 13/6395 307/130
(Continued)

FOREIGN PATENT DOCUMENTS

CN 101378160 A 3/2009
DE 41 14 921 A1 11/1992
(Continued)

OTHER PUBLICATIONS

German Office Action, dated Nov. 20, 2015, for German Application No. 10 2015 004 808.2, 3 pages.
(Continued)

*Primary Examiner* — Gary Paumen
(74) *Attorney, Agent, or Firm* — Seed IP Law Group LLP

(57) ABSTRACT

The disclosure relates to a modular plug connector which has a plug comprising a plurality of plug modules and has a mating plug comprising a plurality of mating plug modules, in which each plug module forms a plug module pair with a mating plug module, wherein the plug and the mating plug can assume an interconnected state and wherein at least one of the plug module pairs has at least one locking device, which can assume a locking state in the interconnected state of the plug and the mating plug, in which locking state the locking device prevents the plug module and the mating plug module of said plug module pair from separating from each other.

5 Claims, 5 Drawing Sheets

(51) Int. Cl.

| | |
|---|---|
| ***H01R 13/193*** | (2006.01) |
| ***H01R 13/639*** | (2006.01) |
| ***H01R 13/514*** | (2006.01) |
| ***H01R 13/518*** | (2006.01) |
| ***H01R 13/627*** | (2006.01) |
| *H01R 13/506* | (2006.01) |
| *H01R 13/53* | (2006.01) |
| *H01R 13/713* | (2006.01) |

(52) U.S. Cl.
CPC ..... *H01R 13/627* (2013.01); *H01R 13/6273* (2013.01); *H01R 13/506* (2013.01); *H01R 13/53* (2013.01); *H01R 13/7137* (2013.01)

(58) Field of Classification Search
USPC ..... 439/345–373, 161
See application file for complete search history.

(56) References Cited

U.S. PATENT DOCUMENTS

| | | | | |
|---|---|---|---|---|
| 5,641,299 | A * | 6/1997 | Meguro | H01R 13/639 439/347 |
| 5,658,162 | A | 8/1997 | Harting et al. | |
| 5,762,512 | A * | 6/1998 | Trant | H01M 2/1055 320/114 |
| 7,322,842 | B2 * | 1/2008 | Duck | G02B 6/381 200/51.03 |
| 9,112,307 | B2 | 8/2015 | Leroyer et al. | |
| 2003/0194914 | A1 * | 10/2003 | Duck | G02B 6/381 439/701 |
| 2004/0235344 | A1 | 11/2004 | Kleeberger et al. | |
| 2011/0246014 | A1 * | 10/2011 | Sauper | B60L 11/1818 701/22 |
| 2016/0072224 | A1 * | 3/2016 | Ichio | B60L 11/1818 439/345 |

FOREIGN PATENT DOCUMENTS

| | | | |
|---|---|---|---|
| DE | 202 05 787 | U1 | 8/2002 |
| DE | 102 43 899 | A1 | 4/2004 |
| DE | 10 2010 045 131 | A1 | 3/2012 |
| EP | 0 731 534 | B1 | 12/1999 |
| EP | 1 353 412 | A2 | 10/2003 |
| EP | 2 728 677 | A1 | 5/2014 |

OTHER PUBLICATIONS

International Search Report and Written Opinion, dated Jun. 17, 2016, for International Application No. PCT/DE2016/100122, 13 pages. (with English Translation of Search Report).

* cited by examiner

MODULAR PLUG CONNECTOR

BACKGROUND

Technical Field

The present disclosure relates to a modular plug-and-socket connector.

Description of the Related Art

Modular plug-and-socket connectors are utilized in highly diverse technical applications. Modular plug-and-socket connectors are based on the technical principle of conducting several different signals or currents, including electrical currents and/or fluid flows and/or light, via multiple plug-and-socket modules and mating connector modules which are interconnected in the connected state of the plug and the mating connector of the modular plug-and-socket connector. One plug module and one mating connector module form one plug module pair in each case, via which a certain desired signal or a desired current or a desired fluid flow or a desired light or a desired luminous flux, which is, e.g., a luminous flux for the purpose of optoelectronic data transmission, can be conducted. Due to the module principle, the conduction of these different signals or flows or fluxes can be implemented by a connecting process which can be carried out in a simple and practical way. One typical application of a modular plug-and-socket connector relates to supplying a system with different signals or different flows or fluxes with the aid of a system controller remote from the system. One example of a modular plug-and-socket connector is known from EP 1 353 412 A2.

In particular, when high electrical currents are transmitted or conducted via a modular plug-and-socket connector in the connected state of plug and mating connector, a high level of risk in the form of an electric arc effectuated by the disconnection process can result when the plug and the mating connector are disconnected under load, during which, inter alia, the plug module and the mating connector module of the plug module pair (or plug module pairs) that conducts the high electrical current are separated from each other. Depending on the application, an inadvertent disconnection of plug and mating connector can also result, e.g., in a system shutdown which, e.g., in the case of an industrial production system, can result in manufacturing defects. In order to avoid or rule out an inadvertent disconnection of plug and mating connector, it is known to secure the connection between plug and mating connector, specifically by way of the connection between plug and mating connector being locked or closably locked by complex latching yokes on the plug and/or the mating connector, in the manner as described, e.g., in EP 0 731 534 B1. Furthermore, it is also known to secure the connection of plug and mating connector against an unauthorized or unwanted separation of the connection by complex plug units or complex plug devices. The known latching yokes as well as the known plug units or plug devices furthermore take up a great deal of installation space.

BRIEF SUMMARY

Embodiments of the present invention provide a modular plug-and-socket connector in which an existing connection between plug and mating connector can be secured against an inadvertent disconnection in a simple and practical way.

The modular plug-and-socket connector according to an embodiment of the present invention comprises a plug including a plurality of plug modules and a mating connector including a plurality of mating connector modules, in which one plug module and one mating connector module form one plug module pair in each case. The plug and the mating connector can assume an interconnected state in which plug module and mating connector module of each of the plug module pairs are interconnected. Furthermore, the plug and the mating connector can assume a disconnected state, in which a plug module and a mating connector module of each of the plug module pairs are separated from each other.

The modular plug-and-socket connector according to an embodiment of the present invention is distinguished by at least one of the plug module pairs comprising at least one locking device which, in the connected state of the plug and the mating connector, can assume a locking state in which the locking device prevents the plug module and the mating connector module of this plug module pair from separating from each other, and can assume a release state in which the plug module and the mating connector module of this plug module pair can be separated from each other.

Given that at least one of the plug module pairs comprises at least one such locking device, in the connected state of plug and mating connector, a separation or inadvertent separation or disconnection of the plug and the mating connector from each other can be advantageously prevented in a simple and practical way, specifically by way of the locking device, in the connected state, assuming the locking state or being transferred into the locking state in which the locking device prevents the plug module and the mating connector module of this plug module pair from separating from each other. In contrast to the known solutions in which complex latching yokes on the plug and/or the mating connector—of the type described, e.g., in EP 0 731 534 B1—or complex plug units or plug devices must be utilized for locking the connection, the complexity involved in securing the connection of plug and mating connector can be substantially reduced by providing the locking device, which is provided only on at least one of the plug module pairs. In particular, the installation space to be provided for securing the connection can also be advantageously substantially reduced, since the locking device can be spatially limited to the one or the at least one plug module pair. Instead of implementing a locking device, in a complex manner, externally on the plug and/or mating connector for the purpose of securing, as in one known solution, at least one plug module pair comprises at least one of these locking devices, by which, in the connected state of plug and mating connector, a separation of the plug and the mating connector from each other can be prevented in a simple and practical way. By utilizing the modular plug-and-socket connector according to embodiments of the present invention, a complex external installation of locking devices can be advantageously dispensed with. It is also advantageously possible to dispense with a complex usage of known plug devices in which a relatively large quantity of high-cost noble metals is generally processed. Particularly advantageously, a utilization of known plug devices in the installation area in particular can be dispensed with.

In the locking state, the plug module and the mating connector of the plug module pair are prevented from separating from each other, specifically preferably by way of the plug module being fixed or immobile relative to the mating connector module or by way of the mating connector module being fixed or immobile relative to the plug module, so that, in particular, the plug module and the mating connector module can be prevented from being separated from each other by plug module and mating connector module being pulled apart.

It is understood that the locking device can be provided either on the plug module of the plug module pair or on the mating connector module of the plug module pair or can be distributed between the plug module and the mating connector module.

In one preferred embodiment of the modular plug-and-socket connector according to the present disclosure, in the connected state of the plug and the mating connector, at least one plug module pair is designed as a power supply line or as at least one power supply line and/or at least one plug module pair is designed as an optical waveguide or as at least one optical waveguide, and/or at least one plug module pair is designed as a fluid line and/or as at least one fluid line. In many applications, multiple plug module pairs or all plug module pairs of the modular plug-and-socket connector, in the connected state of the plug and the mating connector, are preferably designed as at least one power supply line or as at least one optical waveguide or as at least one fluid line, wherein, when all plug module pairs of the modular plug-and-socket connector have such a design in the connected state, the at least one plug module pair comprising the at least one locking device in the connected state of the plug and the mating connector is also designed as at least one power supply line or as at least one optical waveguide or as at least one fluid line.

It is understood that not all plug module pairs of the plug-and-socket connector in the connected state must be designed as at least one power supply line or as at least one optical waveguide or as at least one fluid line. In this way, at least one plug module pair of the modular plug-and-socket connector can also be formed from a so-called blind module and a mating blind module, which simply occupy an unused plug slot or module slot in the plug or the mating connector. Depending on the individual configuration of the modular plug-and-socket connector, not all plug slots or module slots of the plug and mating connector of a modular plug-and-socket connector are utilized. These unused or unoccupied slots are then occupied by a blind module or a mating blind module—in particular in order to avoid an unwanted ingress of moisture or for meeting other safety requirements—which are not designed for conducting current or light or fluid (such as, e.g., air or, e.g., compressed air).

Preferably, the plug modules are accommodated or fixedly accommodated in a holding frame of the plug, and the mating connector modules of the mating connector are accommodated or fixedly accommodated in a holding frame of the mating connector. Particularly preferably, the plug modules and the mating connector modules can be detachably accommodated or fixedly and detachably accommodated in the particular holding frame.

In one particularly preferred embodiment of the modular plug-and-socket connector, the locking device transitions from the release state into the locking state when the temperature of the modular plug-and-socket connector or the plug module pair comprising the locking device increases, and transitions from the locking state into the release state when the temperature of the modular plug-and-socket connector or the plug module pair comprising the locking device decreases, or the locking device is configured for transitioning from the release state into the locking state when the temperature of the modular plug-and-socket connector or the plug module pair increases, and for transitioning from the locking state into the release state when the temperature of the modular plug-and-socket connector or the plug module pair comprising the locking device decreases. In the case of a modular plug-and-socket connector designed according to this particularly preferred embodiment, it is advantageously possible to take advantage of the fact that, during conduction of electrical current via at least one plug module pair configured for this purpose, in particular, this plug module pair or the entire modular plug-and-socket connector heats up. As a consequence of this heating-up or as a consequence of this temperature increase, the locking device can transition from the released state into the locking state, whereby an inadvertent disconnection of the plug and the mating connector from each other is prevented, specifically particularly advantageously when high electrical currents are transmitted via the plug module pair. In this situation, the modular plug-and-socket connector is under load, and so, in particular, a risk that would result in the event of an inadvertent disconnection of plug and mating connector can be effectively avoided. The risk that exists in the case of high electrical currents is primarily that the disconnection will generate a dangerous electric arc. Particularly advantageously, by this embodiment, a state-dependent securing of the connection of plug and mating connection can be implemented, which effectively increases personal protection, and so not only technical personnel but other users as well are able to handle the modular plug-and-socket connector. The network quality is also improved by the effective avoidance of an inadvertent disconnection of plug and mating connection.

Particularly advantageously, in the aforementioned particularly preferred embodiment, the locking device can be configured for transitioning into the locking state when a predefined temperature of the modular plug-and-socket connector is exceeded or if a predefined temperature of a plug module pair or of the plug module pair comprising the locking device is exceeded. The temperature measurement can take place for this purpose by a suitable temperature-measuring device which comprises a temperature sensor provided on the modular plug-and-socket connector or the plug module pair. The predefined temperature is preferably within a range of 5 degrees to 10 degrees Celsius above ambient temperature.

In order to prevent the plug module and the mating connector module from being separated or inadvertently separated from each other, the locking device can be configured for forming or establishing, in the locking state, a form-fitting and/or force-locked connection between the plug module and the mating connector module. In particular, the locking device can be configured for pressing the plug module and the mating connector module against each other.

In one particularly practical embodiment of the modular plug-and-socket connector according to the present disclosure, the locking device comprises at least one element made of a shape memory alloy. A shape memory alloy is distinguished, in a known way, by the fact that it can be converted from a first phase (typically, e.g., the so-called martensite phase) into a second phase (typically, e.g., the so-called austenite phase) by increasing the temperature and can return from the second phase into the first phase by means of cooling, wherein the phase transition from the first phase into the second phase is accompanied by an extension of the shape memory alloy or the element, and the phase transition from the second phase back into the first phase is accompanied by a contraction of the shape memory alloy or the element.

Due to a temperature increase of the modular plug-and-socket connector or of the plug module pair comprising the locking device, in particular due to a temperature increase that exceeds a predefined extent (of, e.g., 10 degrees Celsius with respect to room temperature or ambient temperature), the element made of the shape memory alloy (as described above) extends and, due to the extension, the locking device transitions from the release state into the locking state and, in the case of a temperature decrease, in particular a temperature decrease by the predefined extent, the element made of the shape memory alloy (as described above) contracts or contracts again, and the locking device transitions from the locking state into the release state as a result of the contraction. Due to the extension of the element resulting from the phase transition, a form-fitting and/or force-locked connection between the plug module and the mating connector module is formed or established for the purpose of assuming the locking state and, due to the return into the first phase when the temperature decreases, the form-fitting and/or force-locked connection between the plug module and the mating connector module is released. The predefined extent of the temperature increase or the temperature decrease, which depends not only on the material properties of the shape memory alloy utilized, but also on the thermodynamic properties of the modular plug-and-socket connector, typically lies within a range of 5 degrees Celsius to 20 degrees Celsius.

By providing the element made of the shape memory alloy, it is particularly advantageously possible to implement a highly compact locking device and, therefore, also a highly compact modular plug-and-socket connector having a highly compact and small size which can be implemented, particularly advantageously, without a complex mechanical actuator. As soon as the temperature of the plug module pair or the temperature of the modular plug-and-socket connector increases—e.g., as a result of a conduction of electrical current via the modular plug-and-socket connector—by an extent that effectuates the phase transition of the shape memory alloy, the locking device transitions into the locking state in order to secure the existing connection of plug and mating connector against an inadvertent disconnection or separation. The modular plug-and-socket connector that can be implemented in this way can be incorporated particularly advantageously seamlessly into existing technical systems due, in particular, to the compact design that was made possible, and can optionally implement desired technical functions or requirements such as, e.g., reliable automation solutions, that have not been possible so far.

In yet another practical embodiment of the modular plug-and-socket connector according to the present disclosure, the locking device comprises at least one upper element made of the shape memory alloy, and a mating part, wherein the element is separated from the mating part in the release state of the locking device and is engaged with the mating part in the locking state of the locking device. By way of the mating part, a stable, form-fitting connection of plug module and mating connector module can be advantageously formed, which effectively secures an existing connection of plug and mating connector against an inadvertent disconnection or separation.

In one practical embodiment of the modular plug-and-socket connector according to the present disclosure, the locking device comprises an activatable actuator including a movable connection element which, upon activation of the actuator by appropriate control signals, can be moved or transferred between an opening position and a closing position, wherein the locking device assumes the release state when the connection element is in the opening position and assumes the locking state when the connection element is in the closing position.

When the connection element is in the closing position, the locking device assumes the locking state in particular by way of the movement element forming or establishing a form-fitting connection or a force-locked connection, or a form-fitting and force-locked connection between the plug module and the mating connector module.

By way of the activatable actuator, an existing connection of plug and mating connector can be secured against an inadvertent disconnection or separation by activating said actuator using appropriate control signals, in particular in the form of a closing signal or an opening signal, and can be released once more in order to separate plug and mating connector from each other. Due to the activatability by control signals, the securing and release of the connection of plug and mating connector can be incorporated into highly diverse technical applications, which can be highly advantageous, in particular, in processes having high levels of automation. The closing signal can be designed, in particular, in the form of a "zero signal," and so the locking state is assumed or retained when the actuator is not activated by a voltage or a signal. The opening signal can also be designed, in particular, in the form of a "zero signal," and so the release state is assumed or retained when the actuator is not activated by a voltage or a signal.

The plug module preferably comprises the actuator, and the mating connector module preferably comprises a receptacle in which the connection element can be accommodated in the closing position, or the mating connector module comprises the actuator, and the plug module comprises a receptacle in which the connection element can be accommodated in the closing position. By providing the particular receptacle, a particularly stable securing of the connection of plug and mating connector can be implemented, in particular when the receptacle has a shape or design adapted to the connection element or when the receptacle has a shape or design adapted to a section or end section of the movement element which is accommodated in the receptacle in the closing position.

The connection element can be designed, e.g., in the form of a locking bolt which can be accommodated in the particular receptacle in the closing position, in order to secure or lock the connection of plug and mating connector.

Particularly preferably, the modular plug-and-socket connector comprises a temperature-measuring device for measuring a temperature of the modular plug-and-socket connector, as well as a control device, wherein the control device is configured for activating the actuator and for transferring the locking device from the release state into the locking state or from the locking state into the release state if a temperature measured by the temperature-measuring device exceeds or falls below a predefined limiting value. In addition, by providing such a temperature-measuring device, it is advantageously possible to take advantage of the fact that, during conduction of electrical current via at least one plug module pair configured for this purpose, in particular, this plug module pair or the entire modular plug-and-socket connector heats up. As a consequence of this heating-up or as a consequence of this temperature increase, the locking device can be transferred from the released state into the locking state, whereby an inadvertent disconnection of the plug and the mating connector from each other is prevented, specifically particularly advantageously when high electrical currents are transmitted via the plug module pair.

In yet another practical embodiment of the modular plug-and-socket connector according to the present disclosure, the plug module pair comprising the locking device includes a display which is configured for displaying whether the locking device is presently in the release state or in the locking state. Via the display, the user is advantageously visually informed whether the existing connection of plug and mating connector is secured against an inadvertent separation, or not.

The display can comprise, in particular, an optical waveguide or a viewing window or a transparent seal, wherein the user can visually detect the locking state or the release state of the locking device via the optical waveguide or the viewing window or the transparent seal.

The plug module pair that comprises the locking device can be designed, in the connected state of the plug and the mating connector, as at least one power supply line or as at least one electrical power supply line or as at least one optical waveguide or as at least one fluid line. The plug module pair comprising the locking device can therefore also perform not only the locking function in this design, but also the function of conducting electrical current or light or fluid, which is optionally also already performed by further plug module pairs of the modular plug-and-socket connector. Depending on the application, it can be advantageous to additionally configure the plug module pair comprising the locking device for conducting electrical current or light or fluid. The plug module pair comprising the locking device can also be provided only for the locking described, of course, and so the function of conducting electrical current or light or fluid is optionally reserved for other plug module pairs.

When—as is the case, in particular, in many applications—in the connected state of the plug and the mating connector, at least one plug module pair is designed as at least one power supply line and/or at least one plug module pair is designed as at least one optical waveguide and/or at least one plug module pair is designed as at least one fluid line—or when the plug module and the mating connector module of this plug module pair are designed for the connection and the conduction of electrical current or light or fluid—the modular plug-and-socket connector according to the present disclosure comprises, in one preferred embodiment, a connection socket which can be connected to an external connection mating socket for supplying at least one plug module pair with current or electrical current and/or for supplying at least one plug module pair with light and/or for supplying at least one plug module pair with fluid. Due to such a connection socket, wherein either the plug or the mating connector comprises this connection socket, the plug or the mating connector for supplying current and/or light and/or fluid can be connected to an external connection mating socket which, in particular, can be installed, e.g., in a switchgear cabinet or a system control cabinet. The connection socket is therefore also utilized, in particular, for the technical implementation of connections to switchgear cabinets.

It is particularly preferred when the connection socket and at least one element or at least one part of the locking device are situated on the plug or the mating connector, wherein, particularly preferably, the connection socket and the locking device are situated, in entirety, on the plug or on the mating connector, or the connection socket and the locking device, apart from one to two elements or parts, are situated on the plug or on the mating connector. This has the advantage that the particular other side, i.e., the mating connector or the plug, that can be connected, in particular, to a cable or a media-conducting line, can be designed to be highly space-saving and low-cost, since the locking device is provided, in entirety or to a preponderant extent, on the side comprising the connection socket.

In one particularly preferred embodiment of the modular plug-and-socket connector according to the present disclosure, the locking device is configured for assuming the locking state when at least one plug module pair conducts the light and/or when at least one plug module pair conducts the current and/or when at least one plug module pair conducts the fluid and/or when there is a voltage present at at least one plug module pair and/or when there is a voltage present at the modular plug-and-socket connector. In order to technically implement this function, the locking device can comprise, e.g., at least one sensor and/or at least one measuring device and/or a signal-transmitting connection to at least one sensor and/or at least one measuring device, wherein the sensor or the measuring device is configured for detecting an optionally present current or electrical current or an optionally present fluid flow or an optionally present luminous flux at the particular plug module pair or an optionally present voltage at the particular plug module pair or at the modular plug-and-socket connector. If the sensor and/or the measuring device determine that at least one of these currents or at least one of these voltages is present, or if the sensor and/or the measuring device measure at least one electrical current and/or fluid flow and/or luminous flux deviating from a measured value of zero and/or at least one voltage deviating from a measured value of zero, the locking device assumes the locking state, wherein, in particular, e.g., an intelligence stored on a memory component or a command code stored on a memory component can be provided for this function or functionality.

BRIEF DESCRIPTION OF THE SEVERAL VIEWS OF THE DRAWINGS

Exemplary embodiments of the invention are explained in greater detail in the following on the basis of the attached drawings. In the drawings.

Figure 1A:
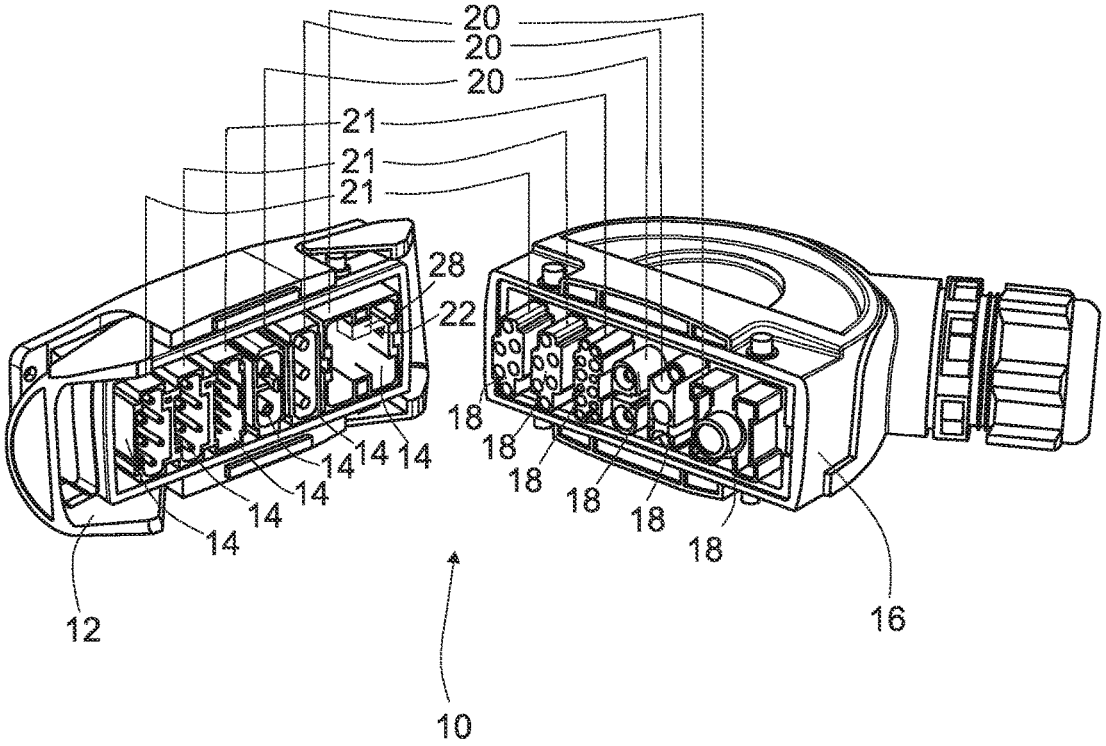
FIG. 1A shows a schematic three-dimensional representation of a first exemplary embodiment of a modular plug-and-socket connector, FIGS. 1B to 1D each show a highly schematic representation of a plug module pair of the plug-and-socket connector according to FIG. 1A in different situations, wherein the plug module pair comprises a locking device, FIGS. 2A and 2B each show a highly schematic representation of a second exemplary embodiment of a modular plug-and-socket connector, FIGS. 2C to 2E each show a highly schematic representation of a plug module pair of the plug-and-socket connector according to FIGS. 2A and 2B in different situations, wherein the plug module pair comprises a locking device.

The modular plug-and-socket connector 10 according to FIG. 1A comprises a plug 12 including a plurality of plug modules 14 and comprises a mating connector 16 including a plurality of mating connector modules 18. In the modular plug-and-socket connector 10, one plug module 14 and one mating connector module 18 form one plug module pair 20 or 21 in each case.

The plug 12 and the mating connector 16 can assume an interconnected state (not illustrated in FIG. 1A) in which plug module 14 and mating connector module 18 of each of the plug module pairs 20 are interconnected, and the plug 12 and the mating connector 16 can assume a disconnected state (as illustrated in FIG. 1A) in which plug module 14 and mating connector module 18 of each of the plug module pairs 20, 21 are separated from each other.

In the connected state of the plug 12 and the mating connector 16, three adjacent plug module pairs 21 are each designed as power supply lines for transmitting control signals or greater electrical currents and two other adjacent plug module pairs 20 are designed, in the connected state, as fluid lines for transmitting fluid in the form of compressed air.

Figure 1B:
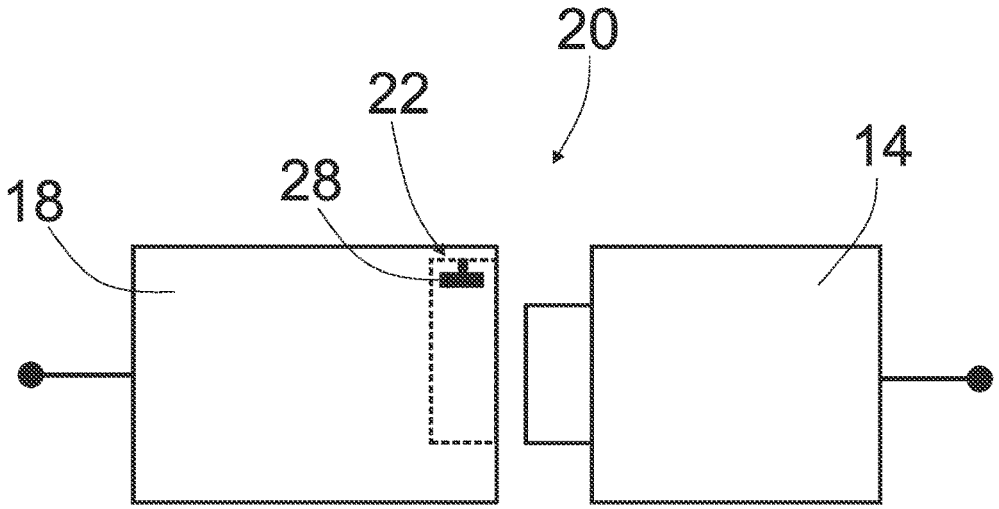
Figure 1C:
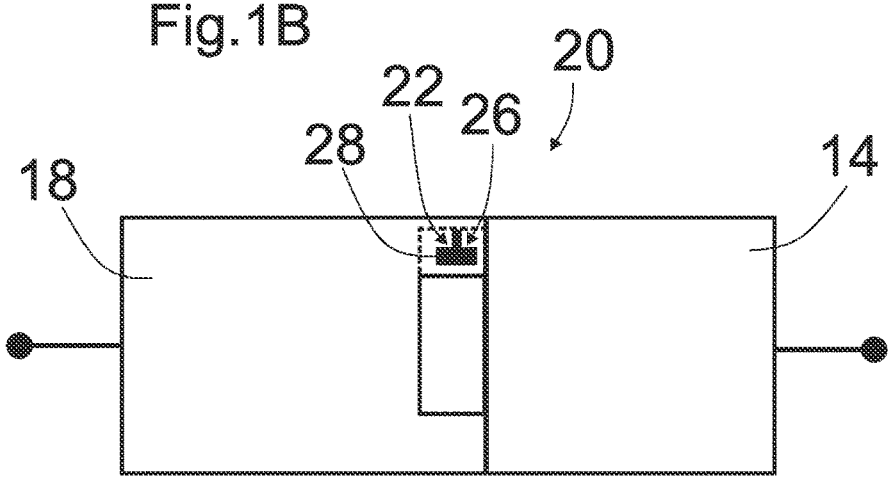
Figure 1D:
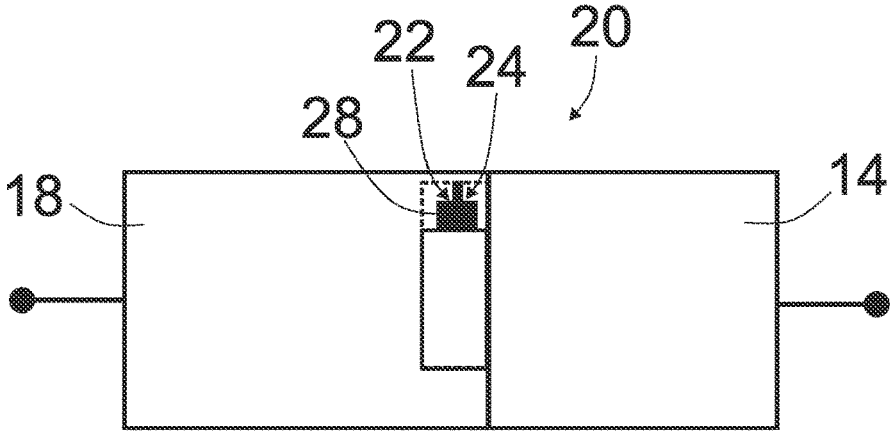

In the exemplary embodiment according to FIG. 1A, a plug module pair 20 comprises a locking device 22. This plug module pair 20 is illustrated highly schematically in FIGS. 1B to 1D. The highly schematically illustrated locking device 22 of the plug module pair 20 comprises an element 28 made of a shape memory alloy. The locking device 22, in the connected state of the plug 12 and the mating connector 16, can assume a locking state 24—in order to secure the connection of plug 12 and mating connector 16 against an inadvertent disconnection or separation—in which the locking device prevents the plug module 14 and the mating connector module 18 of the plug module pair 20 from separating from each other (see FIG. 1D). Furthermore, the locking device 22 can assume a release state 26 in which plug module 14 and mating connector 18 of the plug module pair 20 can be separated from each other (see FIG. 1C).

When there is a temperature increase of the modular plug-and-socket connector 10 or the plug module pair 20 of at least 10 degrees Celsius with respect to the ambient temperature, the locking device 22 transitions from the release state 26 into the locking state 24 as a result of the modular plug-and-socket connector 10 or the plug module pair 20 heating up, and transitions from the locking state 24 into the release state 26 when there is a temperature decrease or cooling of the modular plug-and-socket connector 10 or the plug module pair 20 to ambient temperature. The transition into the locking state takes place passively, specifically by way of the element 28 made of the shape memory alloy extending as a result of the phase transition induced by the temperature increase and, in the extended state, pressing the mating connector module 18 against the plug module 14, i.e., forming or establishing a force-locked connection between the plug module 14 and the mating connector module 18.

Figure 2A:
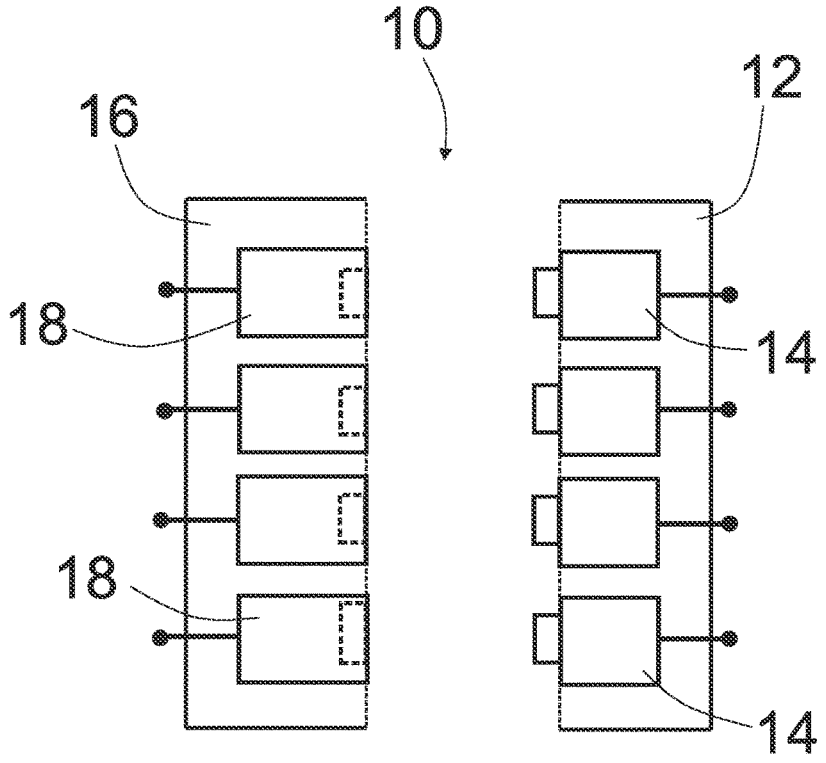
Figure 2B:
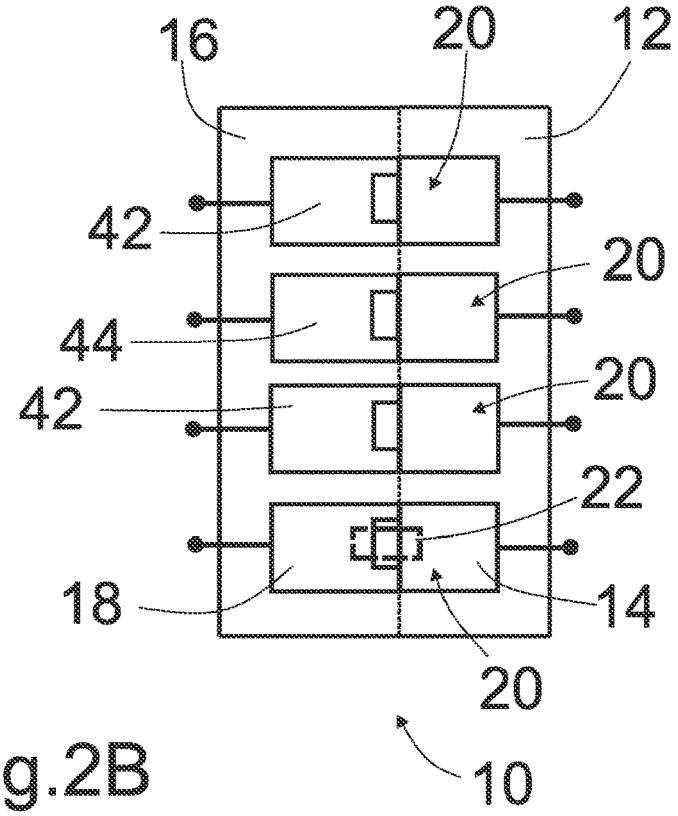

FIGS. 2A and 2B each show a highly schematic representation of a second exemplary embodiment of a modular plug-and-socket connector 10 according to the present disclosure. Two plug module pairs 20 of the modular plug-and-socket connector 10 are formed, in the connected state of the plug 12 and mating connector 16 (see FIG. 2B), as power supply line 42. In the connected state of the plug 12 and the mating connector 16, one plug module pair 20 is designed as optical waveguide 44. Another plug module pair 20, however, does not perform a conduction function, but rather is utilized only for securing the existing connection between plug 12 and mating connector 16, wherein this plug module pair 20 comprises a locking device 22 which is illustrated in greater schematic detail in FIGS. 2C to 2E.

Figure 2C:
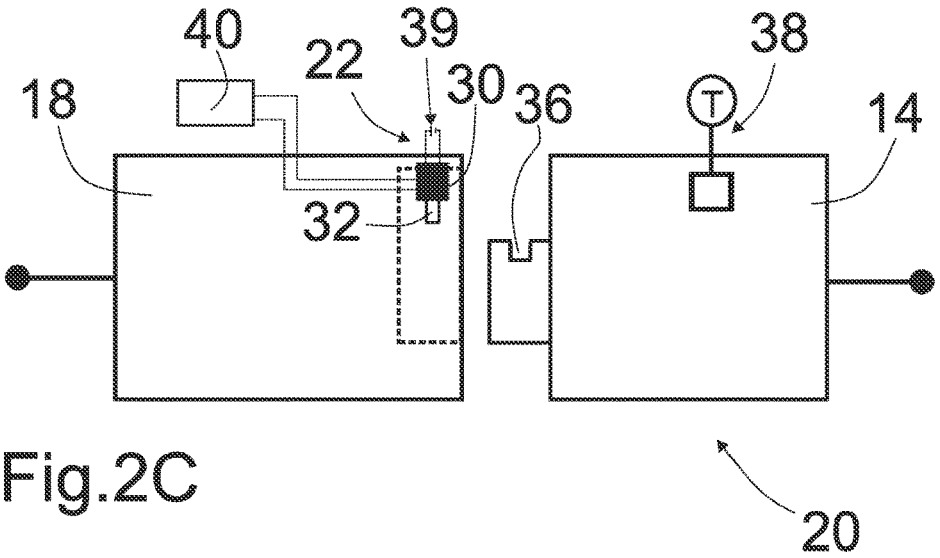
Figure 2D:
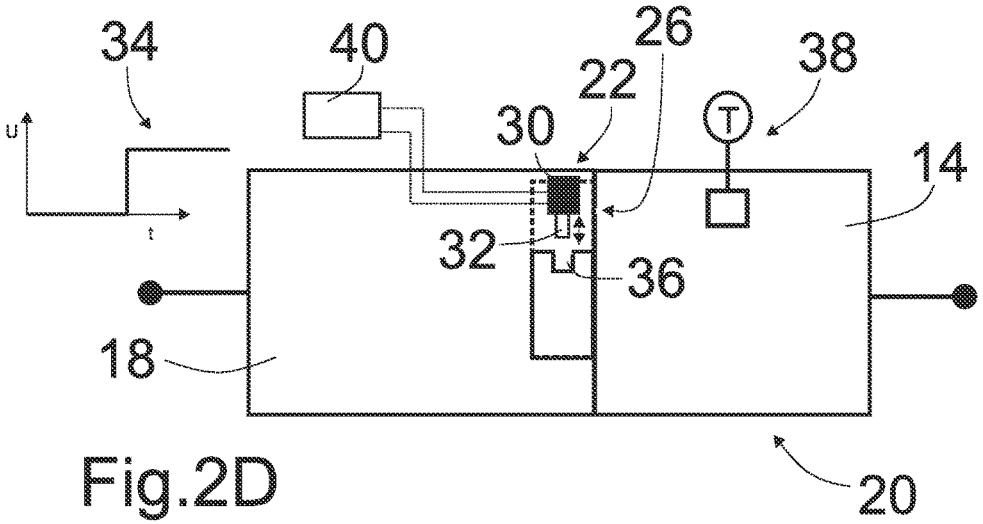
Figure 2E:
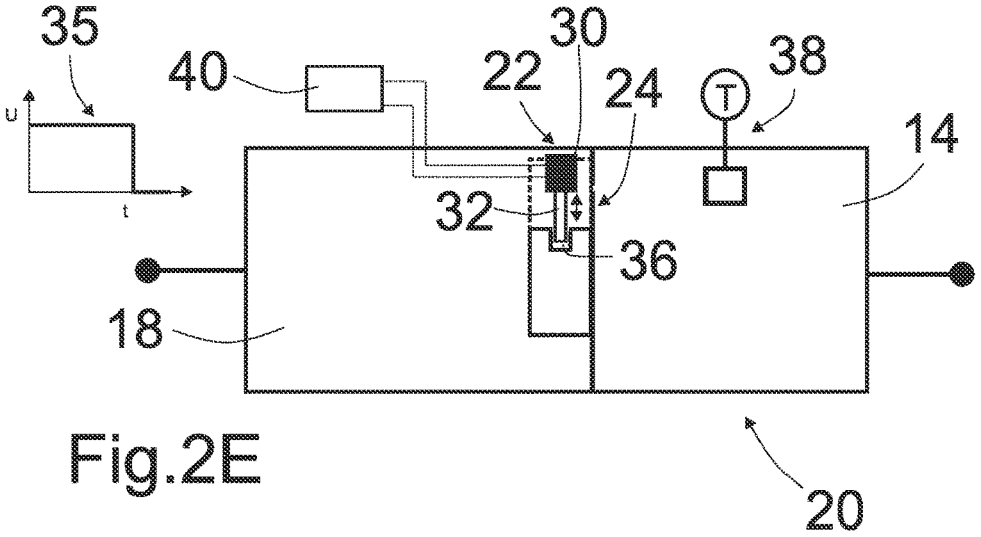

The locking device 22 according to FIGS. 2C to 2E comprises an activatable actuator 30 including a movable connection element 32 which, upon activation of the actuator 30 by means of control signals in the form of an opening signal 34 or a closing signal 35, can be transferred between an opening position (see FIG. 2D) and a closing position (see FIG. 2E), wherein the locking device 22 assumes the release state 26 when the connection element 32 is in the opening position and assumes the locking state 24 when the connection element 32 is in the closing position. The actuator 30 is provided with a supply voltage 39 (illustrated only in FIG. 2C which shows the plug module 14 and the mating connector module 18 in the separated state) which can be provided at the modular plug-and-socket connector 10 or outside thereof.

In the case of the locking device 22, the mating connector module 18 comprises the actuator 30 and the plug module 14 comprises a receptacle 36 of the locking device 22, in which the connection element 32 can be accommodated in the closing position.

In the second exemplary embodiment of the modular plug-and-socket connector 10, the plug-and-socket connector 10 comprises a temperature-measuring device 38 for measuring a temperature of the modular plug-and-socket connector 10 at the plug module 14 of the plug module pair 20 comprising the locking device 22 (see FIGS. 2C to 2E). Furthermore, the modular plug-and-socket connector 10 comprises a control device 40 (illustrated highly schematically in FIGS. 2C to 2E), wherein the control device 40 is configured for activating the actuator 30 and for transferring the locking device 22 from the release state 26 into the locking state 24 or from the locking state 24 into the release state 26 if a temperature measured by the temperature-measuring device 38 exceeds or falls below a predefined limiting value.

Figure 3:
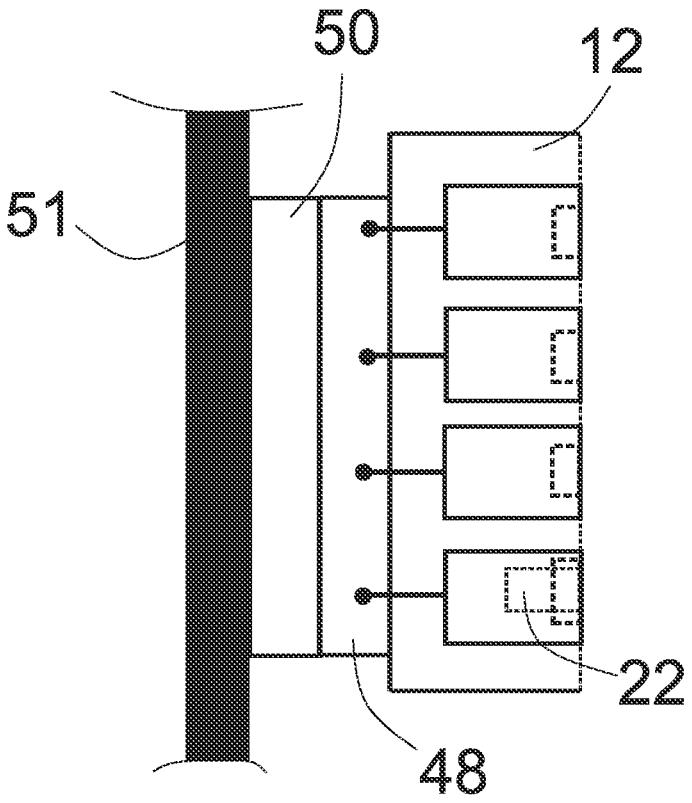
FIG. 3 shows a schematic representation of a plug of a modular plug-and-socket connector according to one embodiment, comprising a connection socket, together with a connection mating socket.

The plug 12 of a modular plug-and-socket connector according to the embodiment of the present disclosure, which is illustrated in FIG. 3, comprises a connection socket 48 which can be connected to an external connection mating socket 50, specifically for supplying each plug module pair of the plug-and-socket connector with current or light or fluid depending on how the particular plug module pair is configured. The connection mating socket 50 is fastened on a housing wall 51 of a control cabinet (not illustrated) of a system. The connection socket 48 and the greatest number of elements or parts of the locking device 22 are situated on the plug 12.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A modular plug-and-socket connector, which comprises a plug including a plurality of plug modules and a mating connector including a plurality of mating connector modules, in which one plug module and one mating connector module form one plug module pair in each case, wherein the plug and the mating connector can assume an interconnected state in which the plug module and the mating connector module of each of the plug module pairs are interconnected, and can assume a separated state in which the plug module and the mating connector module of each of the plug module pairs are separated from each other, wherein at least one of the plug module pairs comprises at least one locking device which, in the interconnected state of the plug and the mating connector, can assume a locking state in which the locking device prevents the plug module and the mating connector module of this plug module pair from separating from each other, and can assume a release state in which the plug module and the mating connector module of this plug module pair can be separated from each other, wherein the at least one locking device comprises an activatable actuator including a movable connection element which, upon activation of the actuator by appropriate control signals, can be transferred between an opening position and a closing position, wherein the at least one locking device assumes the release state when the connection element is in the opening position and assumes the locking state when the connection element is in the closing position, wherein the modular plug-and-socket connector further comprises a temperature-measuring device for measuring a temperature of the modular plug-and-socket connector, and a control device, and wherein the control device is configured for activating the actuator and for transferring the locking device from the release state into the locking state or from the locking state into the release state if a temperature measured by the temperature-measuring device exceeds or falls below a predefined limiting value.

2. The modular plug-and-socket connector of claim 1, in which the plug module comprises the actuator, and the mating connector module comprises a receptacle in which the connection element can be accommodated in the closing position, or in which the mating connector module comprises the actuator, and the plug module comprises a receptacle in which the connection element can be accommodated in the closing position.

3. The modular plug-and-socket connector of claim 1, in which, in the interconnected state of the plug and the mating connector, at least one plug module pair is designed as at least one power supply line and/or at least one plug module pair is designed as at least one optical waveguide and/or at least one plug module pair is designed as at least one fluid line.

4. The modular plug-and-socket connector of claim 3, comprising a connection socket which can be connected to an external connection mating socket for supplying at least one plug module pair with current and/or for supplying at least one plug module pair with light and/or for supplying at least one plug module pair with fluid.

5. The modular plug-and-socket connector of claim 4, in which the connection socket and at least one element of the locking device are situated on the plug or mating connector.

* * * * *